US006059504A

United States Patent [19]

Ishida et al.

[11] Patent Number: 6,059,504

[45] Date of Patent: May 9, 2000

[54] BINDING DEVICE

[75] Inventors: Toshiya Ishida; Toru Yoshie; Kazuaki Baba, all of Tokyo, Japan

[73] Assignee: Max Co., Ltd., Tokyo, Japan

[21] Appl. No.: 09/109,910

[22] Filed: Jul. 2, 1998

[30] Foreign Application Priority Data

| | | | |
|---|---|---|---|
| Jul. 3, 1997 | [JP] | Japan | 9-193283 |
| Jul. 3, 1997 | [JP] | Japan | 9-193284 |
| Jul. 3, 1997 | [JP] | Japan | 9-193285 |
| Jul. 3, 1997 | [JP] | Japan | 9-193286 |

[51] Int. Cl.[7] ..... B42B 5/10; B42D 1/00; B25C 5/02

[52] U.S. Cl. ..... 412/39; 412/40; 412/38; 281/27.2; 227/119; 227/120; 227/155

[58] Field of Search ..... 227/227, 155, 227/119, 120; 281/27.2; 412/42, 38, 39, 40

[56] References Cited

U.S. PATENT DOCUMENTS

| | | | |
|---|---|---|---|
| 708,636 | 9/1902 | Hawthorne | 227/69 |
| 2,097,888 | 11/1937 | Leyerle | 412/40 |
| 2,377,340 | 6/1945 | Grinnell | 140/93 R |
| 3,604,561 | 9/1971 | Mallina | 227/120 |
| 4,181,327 | 1/1980 | Merrill | 281/25 |
| 4,206,863 | 6/1980 | Savino | 227/84 |
| 4,281,690 | 8/1981 | Lemburg | 140/71 |
| 5,549,433 | 8/1996 | Byrne | 412/39 |
| 5,673,838 | 10/1997 | Reitze | 227/120 |
| 5,707,194 | 1/1998 | Blumberg et al. | 412/38 |
| 5,740,712 | 4/1998 | Watkins et al. | 83/549 |

*Primary Examiner*—Willmon Fridie, Jr.
*Assistant Examiner*—Alisa Thurston
*Attorney, Agent, or Firm*—Morgan, Lewis & Bockius LLP

[57] ABSTRACT

A binding device for binding a stack of sheets with a bind member in which parallel legs extend perpendicularly from a straight portion, the binding device comprises: a driver plate which drives the straight portion of the bind member toward the legs; curved shaping guide grooves which are formed to respectively correspond to the legs; and a fulcrum member which is disposed in the vicinity of and inside one end of each of the shaping guide grooves, and which constitutes shaping fulcrums, the shaping fulcrums respectively engaging with side faces of the legs of the bind member which is driven out toward the one end of each of the shaping guide grooves, thereby bendingly shaping the legs, and, during a period after the bind member is driven out and before the legs are formed into ring-like shapes by the fulcrum member and the shaping guide grooves, the legs are passed through punched holes formed in an edge portion of each of sheets.

24 Claims, 10 Drawing Sheets

BINDING DEVICE

BACKGROUND OF INVENTION

The present invention relates to a binding device which causes legs of a bind member to pass through punched holes formed in sheets to be bound, and forms the legs into a ring-like shape, thereby binding the sheets.

For example, plural copied sheets are bound and then distributed during a meeting or presentation. Generally, staples are used as a means for binding sheets. However, this means has a disadvantage in that a spread portion of the bound sheets is difficult to see. Means for bonding together end faces of sheets using a hot melt adhesive is also known. However, the means which uses a hot melt adhesive in binding has a problem in that the adhesive must be cooled after beating and hence the binding process requires a prolonged time period.

A binding device which allows sheets to be completely spread and in which the binding process can be rapidly performed is known. In the device, as shown in FIG. 12(*a*), a bind member 22 is used in which plural U-like pieces 21 perpendicularly project from a straight portion 20 at regular intervals. The U-like pieces 21 are passed through punched holes 24 which are previously formed along edges of sheets 23, respectively. The portions projecting from the punched holes 24 are bent by a bending device as shown in FIG. 12(*b*) to form the pieces into a ring-like shape, whereby the sheets 23 are bound. When sheets are bound by such a binding device, facing pages can be spread 180 degrees, and the whole face of each page can be seen.

However, the binding device has problems as follows. The bind member 22 itself has the plural U-like pieces 21 which are previously shaped, and the length of the member is chosen to correspond to a length of a side of a particular size sheet 23 (for example a B5 size, A4 size, or the like). Therefore, each bind member is bulky. When multiple bind members are prepared, a large space is required, and the bind members may become entangled with one another and hence difficult to handle. Furthermore, the production cost of one bind member is high. Therefore, the work of binding a number of sheets while grouping the sheets into many sets is cumbersome and costly.

SUMMARY OF INVENTION

It is an object or the invention to provide a binding device which can solve the above-discussed problems and can perform multiple binding operations easily and at a low cost.

It is another object of the invention to provide a binding device in which a bind member is formed into a ring-like shapes and sheets are bound via the bind member, and the bind member thus shaped can be easily removed with the sheets from the binding device.

In order to attain this object, the binding device of the invention comprises: a bind member in which parallel legs extend perpendicularly from a straight portion; a driver plate which drives the straight portion of the bind member toward the legs; curved shaping guide grooves which are formed to respectively correspond to the legs; and a fulcrum member which is disposed in the vicinity of and inside one end of each of the shaping guide grooves, and which constitutes shaping fulcrums, the shaping fulcrums respectively engaging with side faces of the legs of the bind member which is driven out toward the one end of each of the shaping guide grooves, thereby bendingly shaping the legs, and, during a period after the bind member is driven and before the legs are formed into ring-like shapes by the fulcrum member and the shaping guide grooves, the legs are passed through punched holes formed in an edge portion of each of sheets.

Instead of the curved shape, the shaping guide grooves may have a shape in which the shaping guide grooves are inclined to form an obtuse angle with respect to axes of the legs of the bind member which is driven out by the driver plate.

According to another aspect of the invention, in the binding device described above, the fulcrum member is movable between a forming position, where the fulcrum member serves as a fulcrum when the driver plate drives the bind member, and a retracting position where the fulcrum member retracts from the bind member thus formed after bending.

Preferably, the fulcrum member has an escape portion to prevent the legs of the bind member from hitting the fulcrum.

According to a further aspect of the invention, in the binding device described above, the shaping guide grooves are formed such that an interval between the shaping guide grooves near the legs is smaller that of the root portion of the bind member so that the legs of the bind member is bent inside the root portion thereof.

According to a further aspect of the invention, in the binding device described above, the fulcrum member is movable perpendicular to a direction of movement of the driver plate, the sheets are put on the fulcrum member so that the legs are positioned above the punched holes of the sheets, and the legs pass through the punched holes prior to the shaping guide grooves.

DETAILED DESCRIPTION OF PREFERRED EMBODIMENTS

Figure 1:
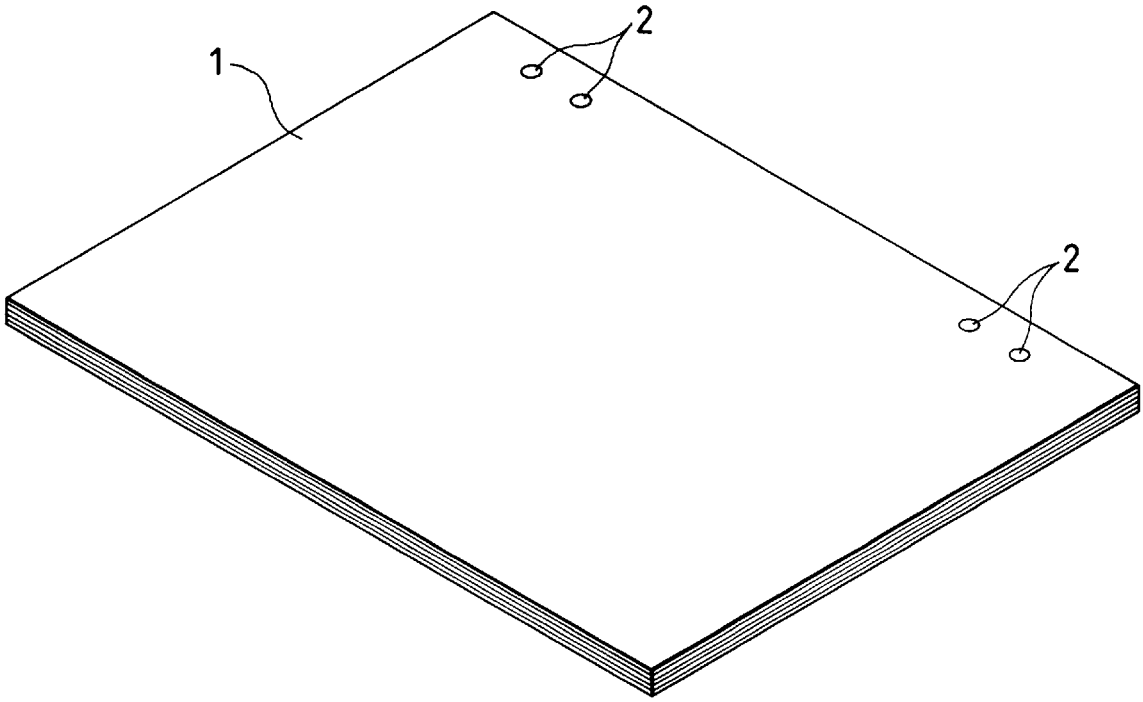
FIG. 1 is a perspective view of sheets to be used with a binding device.
Figure 2A:
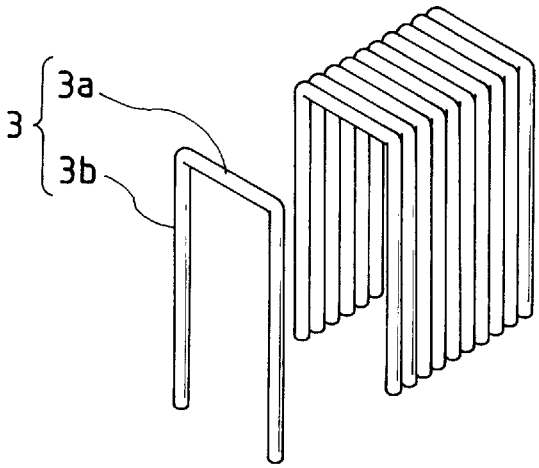
FIG. 2(*a*) is a perspective view of bind members, FIG. 2(*b*) is a perspective view of a binding device according to an embodiment of the invention, and FIG. 2(*c*) is a longitudinal section view of the device.
Figure 2B:
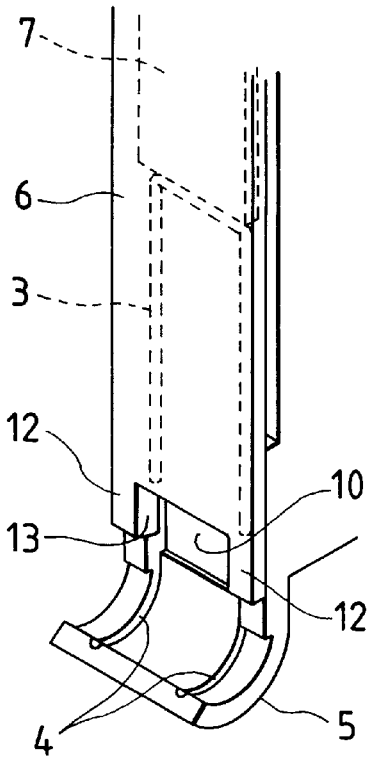
Figure 2C:
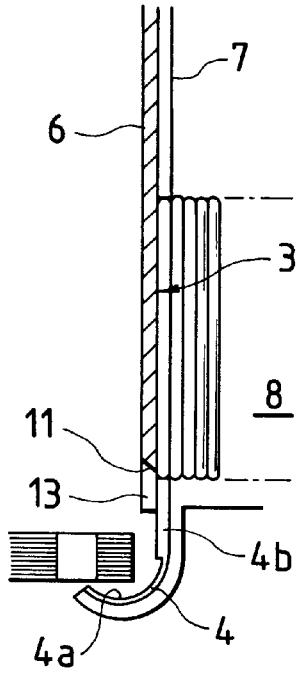

In FIG. 1, sheets 1 are stacked to be bound. Two pairs of punched holes 2 are previously punched in an edge portion of each of the sheets 1 by a punch which is not shown. In FIG. 2(*a*), a bind member 3 is a U-like metal member in which a pair of parallel legs 3*b* extend perpendicularly from the ends of a straight portion 3*a*. Usually, multiple bind members are bonded together so as to form a connected bind member.

FIG. 2(*b*) is a perspective view of the binding device, and FIG. 2(*c*) is a section view of the device. The binding device bends the bind member 3 into a ring-like shape, and comprises: a shaping block 5 having a pair of shaping guide grooves 4; a face plate 6 which is disposed above the shaping block 5; and a driver plate 7 which is vertically movable along the rear face of the face plate 6. A supply path 8 for a connected bind member is formed behind the face plate 6. A connected bind member in the supply path 8 are always pressed against the back face side of the face plate 6 (in the forward direction) by pressing means which is not shown, so that the leading bind member 3 is positioned below the driver plate 7.

Figure 3A:
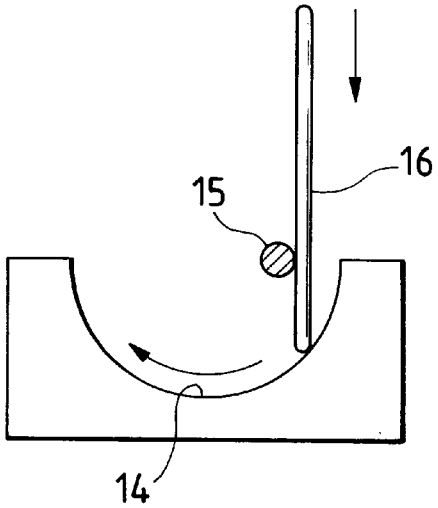
FIG. 3(*a*) is a diagram showing the principle of the shaping in the binding device, and FIG. 3(*b*) is a view showing a manner of shaping a bind member.
Figure 3B:
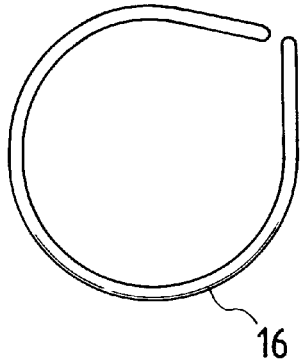

The shaping block 5 has a substantially J-like section shape. The pair of shaping guide grooves 4 are formed in the inner curved face. As shown in FIG. 3(*a*), a half-circular shape may be used as a shaping block 14. It is not necessary to form the shaping guide grooves 4 in the half-circular shaping block 14. Also the groove bottom 4*a* of each shaping guide groove 4 is arcuately formed. The upper ends 4*b* of the shaping guide grooves 4 are positioned such that the legs 3*b* of the leading bind member 3 in the supply path 8 are aligned with the shaping guide grooves 4.

The face plate 6 is disposed so as to be vertically movable together with the driver plate 7. The face plate is configured so that it stops its downward movement at an intermediate point of the downward movement of the driver plate 7 and starts its upward movement from an intermediate point of the upward movement of the driver plate. A center area of the lower portion of the face plate 6 is cut away so that a recess 10 is formed. An inclined upper guide face 11 is formed in the upper end face of the recess 10. The inner side portions of projections 12 which are formed on the sides of the recess 10 are inclined so as to form side guide faces 13.

The principle of forming the bind member 3 into a ring-like shape in the above-mentioned configuration will be described. As shown in FIG. 3(*a*), a shaping fulcrum 15 is disposed in the vicinity of one end of a curved face guide 14 having an arcuate section shape. When a U-like wire member 16 is vertically pressed down between the shaping fulcrum 15 and an end portion of the curved face guide 14, the wire member 16 is not bent until the tip ends of the wire member 16 contacts the curved face guide 14. When the wire member is further pressed down, the tip ends of the wire member are guided along the curved face guide 14. Therefore, the wire member 16 is bent at a location which proceeds the shaping fulcrum 15. As a result, the wire member 16 is formed into a ring-like shape as shown in FIG. 3(*b*). In this way, the wire member 16 which is originally straight can be formed into a ring-like shape by the combination of the shaping fulcrum 15 and the curved face guide 14.

Figure 4A:
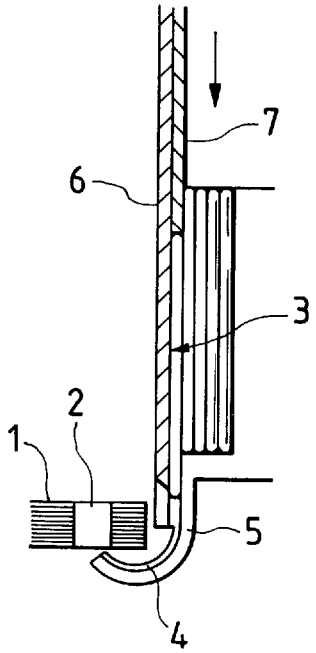
FIGS. 4(*a*) and 4(*b*) are diagrams illustrating a manner of operating the binding device where the bind member has not entered the guide grooves and where the bind member has entered the guide grooves, respectively.
Figure 4B:
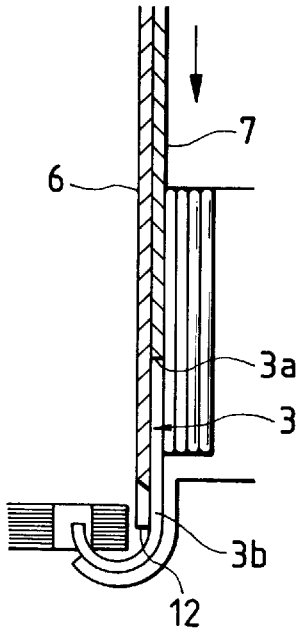
Figure 5A:
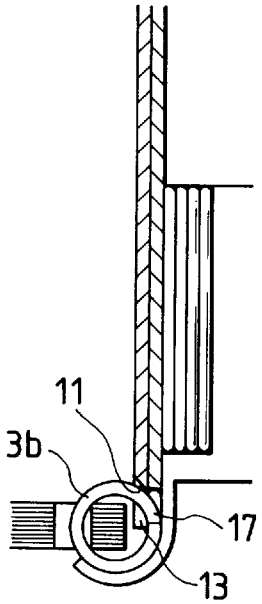
FIG. 5(*a*) is a longitudinal section view and FIG. 5(*b*) is a perspective view showing the case where a driver plate reaches the lowermost position, respectively.
Figure 5B:
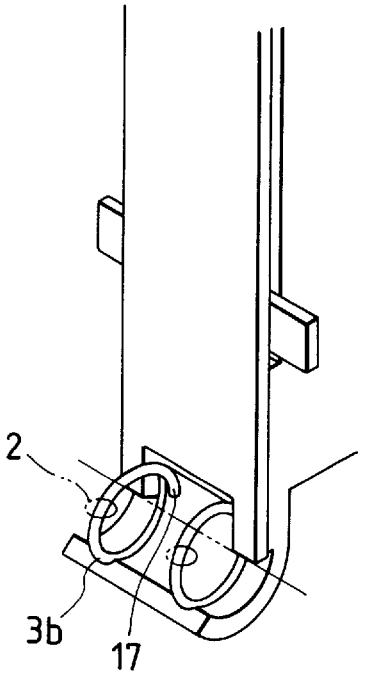
Figure 6:
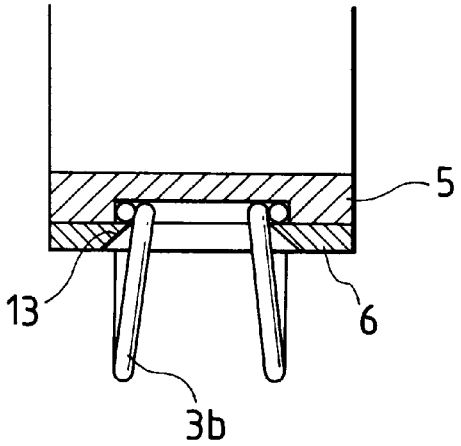
FIG. 6 is a transverse section view illustrating a manner of guiding the bind member.
Figure 7A:
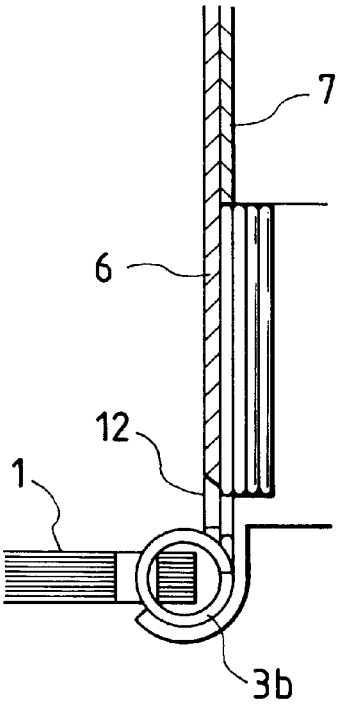
FIG. 7(*a*) is a longitudinal section view and FIG. 7(*b*) is a perspective view showing the case where the driver plate is upward moved, respectively.
Figure 7B:
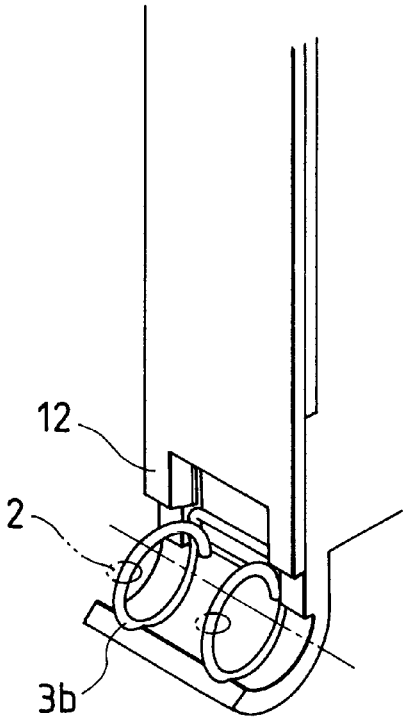
Figure 8:
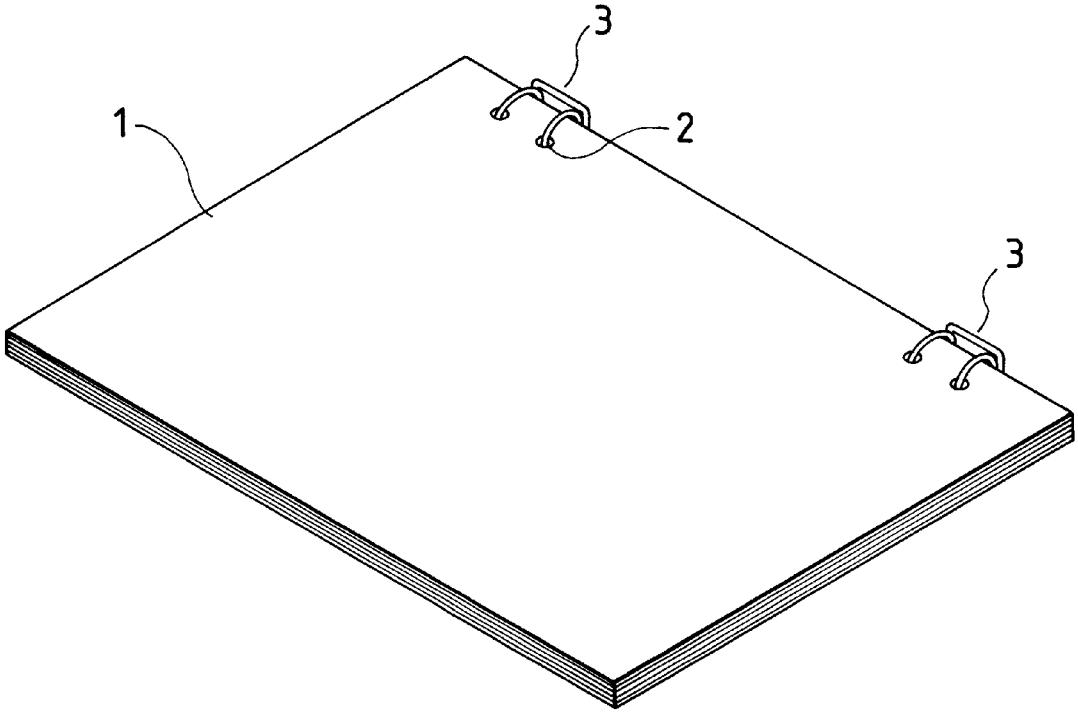
FIG. 8 is a view showing a complete state of the binding.

Next, a manner of using the thus configured binding device will be described. As shown in FIG. 4(*a*), first, the sheets 1 are placed so that a pair of punched holes 2 are correspondingly positioned directly below the tip ends of the shaping guide grooves 4 of the shaping block 5. When the driver plate 7 is moved downward along the back face of the face plate 6, the face plate 6 is lowered to the predetermined position and then stops there, so that the side projections 12 serve as shaping fulcrums. By contrast, the driver plate 7 contacts the straight portion 3*a* of the leading bind member 3 and presses down the portion toward the legs 3*b*. Therefore, the legs 3*b* of the sides of the bind member 3 pass through the space between the tip end of the driver plate 7 and the shaping guide grooves 4, and the tip ends of the legs bump against the groove bottoms of the shaping guide grooves 4 of the shaping block 5 and, as shown in FIG. 4(*b*), are then guided by the projections 12 (shaping fulcrums) of the driver plate 7 so as to be bent along the curved faces of the shaping guide grooves 4, with the result that the legs are curved. When the legs thereafter project from the tip ends of the shaping guide grooves 4, the projecting portions are inserted into the respective punched holes 2 of the sheets 1 while maintaining their curved shape, and then pass through the punched holes 2. Thereafter, the projecting portions approach the recess 10 of the face plate 6, and, as shown in FIGS. 5(*a*), 5(*b*), and 6, are then inwardly guided by the side guide faces 13 of the face plate 6 and caused by the upper guide face 11 to abut against the side faces of the legs 3*b* of the bind member 3, respectively. As a result, the pair of legs 3*b* are formed into one pair of circular ring-like shapes. After the lowermost position, as shown in FIGS. 7(*a*) and 7(*b*), the driver plate 7 moves upward and returns to its initial position. At the same time, also the face plate 6 moves upward to return to its initial position, and the projections 12 (shaping fulcrums) of the driver plate 7 retract such that they no longer contact the bind member 3. Consequently, the bind member 3 can be taken out from the shaping block 5. In this way, the pair of legs 3*b* are formed into one pair of circular ring-like shapes as shown in FIG. 8, and the sheets 1 are bound by the two bind members 3 as illustrated. When the sheets 1 are moved or alternatively the binding device is moved, further bind members 3 can be attached to the sheets 1.

As described above, according to the binding device, the pair of legs 3*b* of the U-like bind member 3 are formed into ring-like shapes. The bind member 3 itself is small in size and the bind member 3 before the shaping operation has a flat shape. Therefore, the bind member 3 occupies a small space and the production cost of one bind member can be made lower than that of a binding device of the prior art. Furthermore, a large number of bind members 3 can be bonded together so as to be connected to one another. Even in the case of a large number of bind members, therefore, the total space required for the whole of the bind members can be reduced. The legs 3*b* are not entangled with one another and hence the binding devices are easy to handle.

The binding work can be performed in a similar manner as that of a conventional stapler and hence is easy to do.

The shape of the bind member 3 is not restricted to a linear member having a circular section. For example, the bind member may be a strip-like member. The bind member is not restricted to a member having two legs, and may be a member having three or more legs. The binding device may be of a type in which a straight band member is formed by the device into a U-like shape having two legs and then driven out.

The shaping guide grooves 4 are shown so as to have a semicircular section shape. The shape of the shaping guide grooves is not restricted to this, and may be formed into an arc such as a quadrant or a three-quadrant.

In the illustrated embodiment, the shaping fulcrums are formed on the projections 12 of the face plate 6 and the face plate 6 serves also as the fulcrum member. However, the fulcrum member is not required to be formed integrally with the face plate 6. For example, a fulcrum member (not shown) which is vertically or horizontally movable may be disposed below the face plate.

Figure 9A:
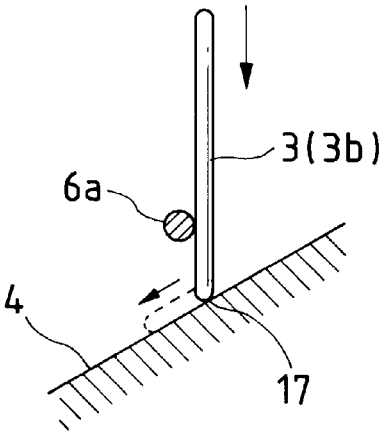
FIG. 9(*a*) is a diagram illustrating another example of the configuration of a shaping guide groove, and FIG. 9(*b*) is a view showing a shaping manner.
Figure 9B:
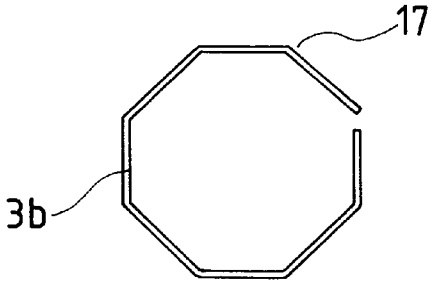

In place of the arcuate shape, the shaping guide grooves 4 may have a shape in which, as shown in FIG. 9(*a*), the shaping guide grooves 4 are inclined to form an obtuse angle with respect to the axes of the legs of the bind member 3 which is driven out by the driver plate. In this case, when the bind member 3 is driven out by the driver plate 7 and the tip ends of the legs 3*b* of the bind member 3 contact the shaping guide grooves 4, the tip end portions which bump against the shaping guide grooves 4 are abruptly guided urged in a direction perpendicular to the axes of the legs 3*b* because the shaping guide grooves 4 are linearly inclined. Therefore, the legs 3*b* are bent at the location which contacts the fulcrum member 6*a*. When the bent portions 17 contact the shaping guide grooves 4, the portions above the bent portions are similarly bent. In this way, as shown in FIG. 9(*b*), the legs 3*b* can be formed into polygonal ring-like portions in accordance with the inclination angle of the shaping guide grooves 4.

Figure 10:
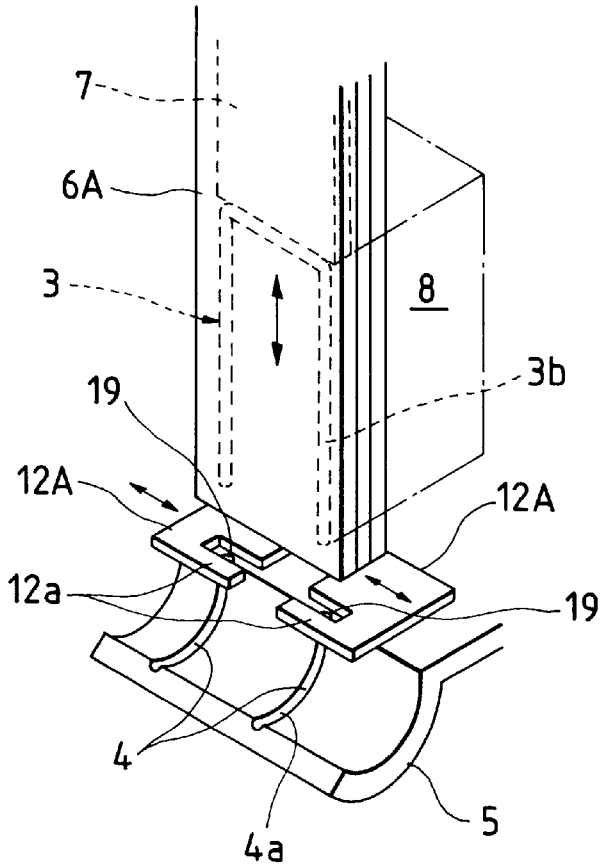
FIG. 10 is a perspective view of a binding device according to another embodiment of the invention.

FIG. 10 shows a further example of the binding device. The binding device comprises: a shaping block 5 having a pair of shaping guide grooves 4; a face plate 6A which is disposed above the shaping block 5; and a driver plate 7 which is vertically movable along the rear face of the face plate 6A; and fulcrum members 12A constituting shaping fulcrums for bendingly shaping legs 3*b* of a bind member 3 which is driven by the driver plate 7. A supply path 8 for a connected bind member is formed behind the face plate 6A.

The face plate 6A is fixed. The bind member 3 and the driver plate 7 are disposed behind the face plate so as to be vertically slidable.

The fulcrum members 12A are formed by a pair of plate-like members. Fulcrum portions 12*a* in the form of a projection piece opposingly project from the opposed faces of the fulcrum members 12A. Grooves 19 through which the respective legs 3*b* of the bind member 3 pass through are formed behind the fulcrum portions 12*a*. Each fulcrum member 12A is disposed in the vicinity of one end of the corresponding shaping guide groove 4. The fulcrum members 12A are disposed movably in lateral directions perpendicular to the operation directions of the driver plate 7 so as to approach to and separate from each other.

Figure 11:
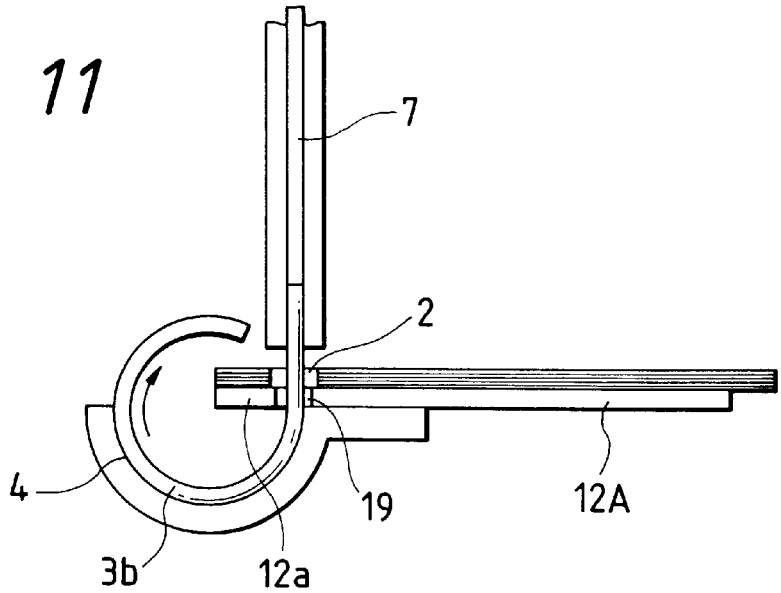
FIG. 11 is a diagram illustrating a manner of guiding a bind member in the binding device.
Figure 12A:
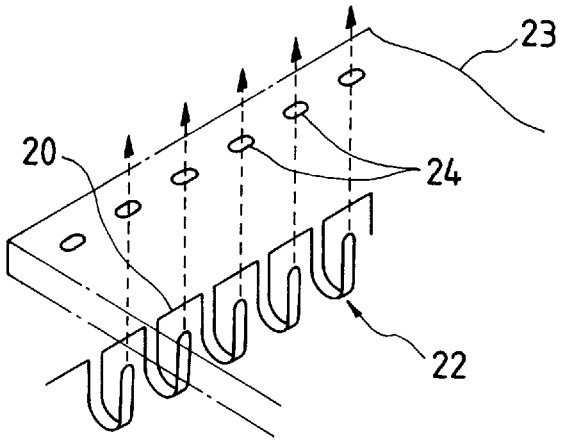
FIG. 12(*a*) is a diagram illustrating the insertion of sheets into a conventional binding device, and FIG. 12(*b*) is a diagram illustrating the shaping of a bind member in a conventional binding device.
Figure 12B:
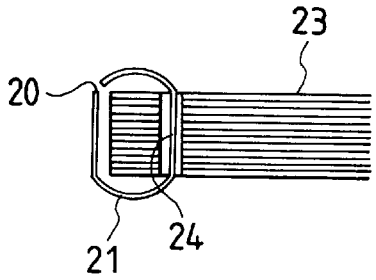

As shown in FIG. 11, sheets 1 are placed on the fulcrum members 12A so that punched holes 2 of the sheets 1 are located between the fulcrum members 12A and the shaping guide grooves 4 and, above the fulcrum members 12A, the punched holes 2 are aligned with the legs 3*b* of the bind member 3.

Figure 20:
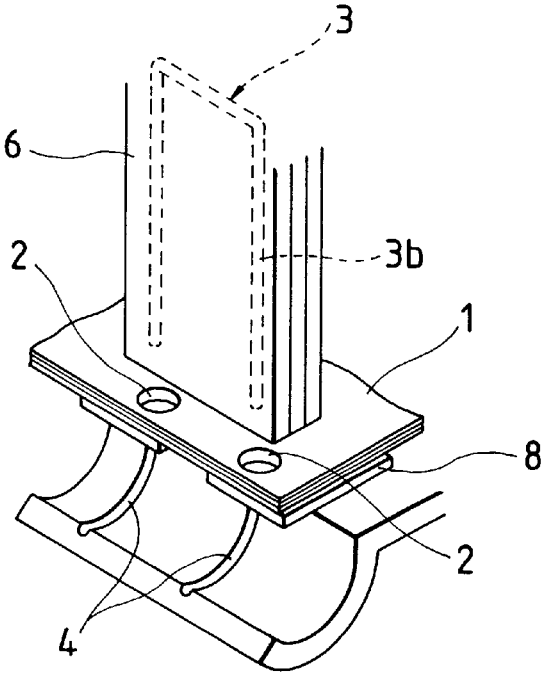
FIG. 20 shows the case where the sheets are put on the fulcrum member.

Next, a manner of using the thus configured binding device will be described. First, as shown in FIG. 20, the sheets 1 are set on the fulcrum members 12A. When the bind member 3 is driven out by operating the driver plate 7, the legs 3*b* pass through the respective punched holes 2 of the sheets 1 to engage with the fulcrum portions 12*a*, and are then guided with using the fulcrum portions as shaping fulcrums so as to be bent along the curved faces of the shaping guide grooves 4, with the result that the legs are formed into a pair of circular ring-like shapes. After reaching the lowermost position, the driver plate 7 moves upward and returns to its initial position. At a substantially same time, the fulcrum members 12A are laterally moved so as to retract from the front of the bind member 3. As a result, the sheets 1 can be removed with the bind member 3.

In this case, the legs 3*b* pass through the punched holes 2 of the sheets 1 before the tip ends of the legs 3*b* enter the shaping guide grooves 4 as a result of the operation of driving the bind member. Therefore, the legs 3*b* of the bind member 3 which are in a straight state pass through the punched holes 2 of the sheets 1, and hence the punched holes 2 are only required to be aligned and are not required to be much larger than the legs of the bind member. Consequently, the sheets 1 can be easily set, and the bound sheets 1 have a play, thereby attaining an effect that the edges are regularly aligned.

The legs 3*b* are formed into ring-like shapes, and the fulcrum members 12A are then moved so as to retract from the bind member 3. Therefore, the bind member 3 which has been shaped can be easily removed together with the sheets 1 from the binding device.

Figure 13A:
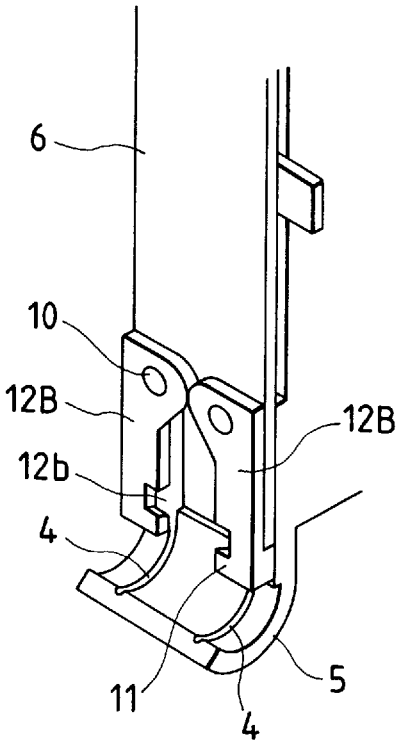
FIG. 13(*a*) is a perspective view of a binding device according to a still further embodiment of the invention, and FIG. 13(*b*) is a longitudinal section view of the device.
Figure 13B:
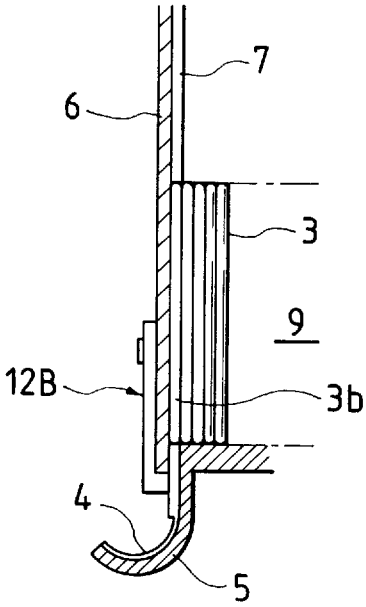

FIG. 13(*a*) is a perspective view of a binding device according to a still further embodiment of the invention, and FIG. 13(*b*) is a longitudinal section view of the device.

This embodiment is similar to the embodiment previously described, but the fulcrum members 12B is different. Each of the fulcrum members 12B is made of a plate member, which is pivoted at a pin 10 of the face plate 6. Fulcrum pieces 11 project from facing surface of the fulcrum members 12B, to face each other. An escape portion 12*b* is formed above each of the fulcrum pieces 11, in order to prevent the legs 3*b* of the bind member 3 from contacting the fulcrum members 12B, while the bind member is being bent in circular shape. The fulcrum members 12B are pivotable between a close position where the fulcrum members 12B serve as shaping fulcrums when the driver plate 7 drives the bind member 3 and a open position where the fulcrum members 12B retract, in order to remove the bind member 3 from the binding device when the driver plate 7 returns its initial position (the uppermost position).

Figure 14A:
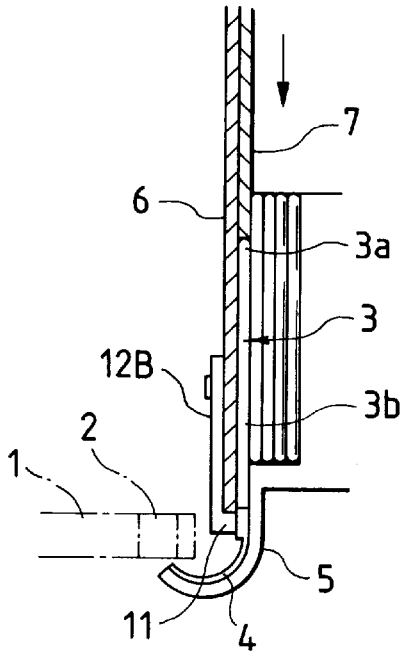
FIGS. 14(*a*) and 14(*b*) are diagrams illustrating a manner of operating the binding device where the bind member has not entered the guide grooves and where the bind member has entered the guide grooves, respectively.
Figure 14B:
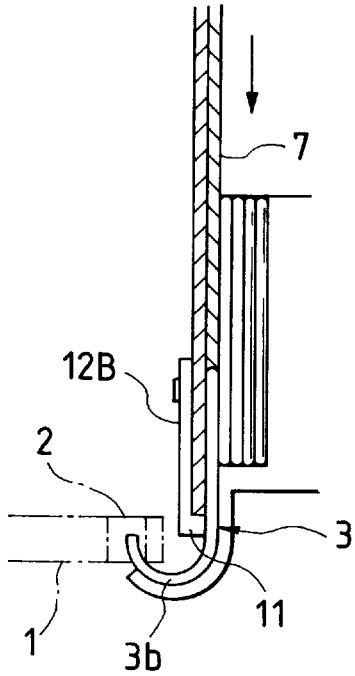
Figure 15:
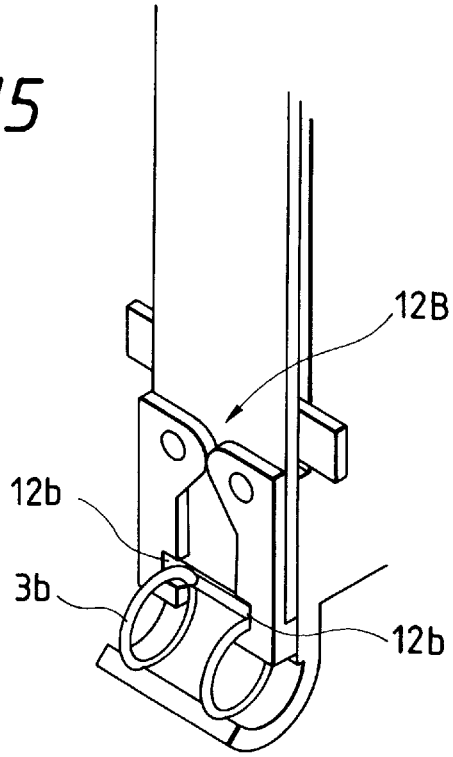
FIG. 15 is a perspective view showing the case where a driver plate reaches the lowermost position.
Figure 16:
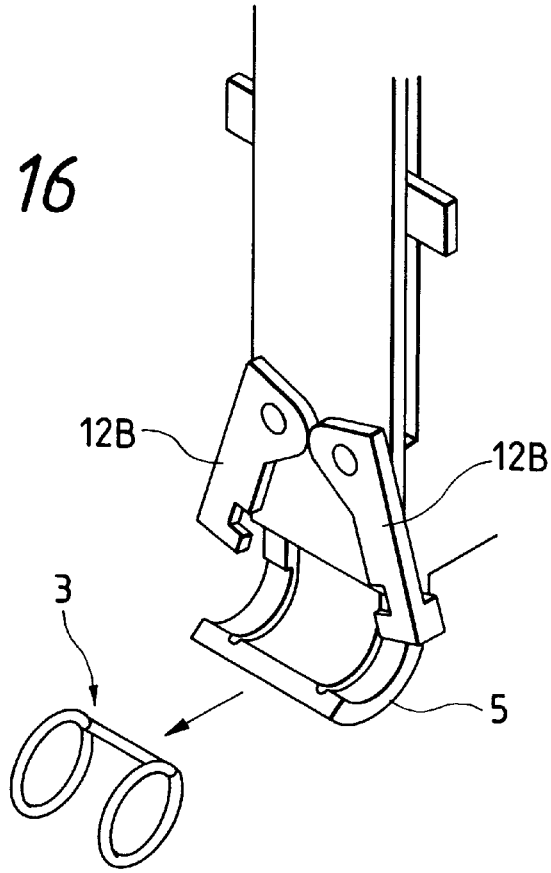
FIG. 16 is a perspective view showing the case where a bind member is removed from the binding device.

Next, a manner of using the thus configured binding device will be described. First, the sheets 1 are set on the fulcrum members 12B, as shown in FIG. 14(*a*). When the bind member 3 is driven out by operating the driver plate 7, as shown in FIG. 14(*b*), the legs 3*b* engage with the fulcrum pieces 11, and are then guided by the fulcrum pieces. The fulcrum pieces act to shape the bind member using the curved faces of the shaping guide grooves 4 then passing through the respective punched holes 2 of the sheets 1, with the result that the legs are formed into a pair of circular ring-like shapes. As shown in FIG. 15, the legs 3*b* thus bent pass through the escaping portions 12*b*, and stop at a root portion of the legs 3*b*, forming the ring-shape. After the lowermost position, the driver plate 7 moves upward and returns to its initial position. At a substantially same time, as shown in FIG. 16, the fulcrum members 12B are pivoted so as to retract from the front of the bind member 3. As a result, the sheets 1 can be removed with the bind member 3 from the binding device.

Figure 17:
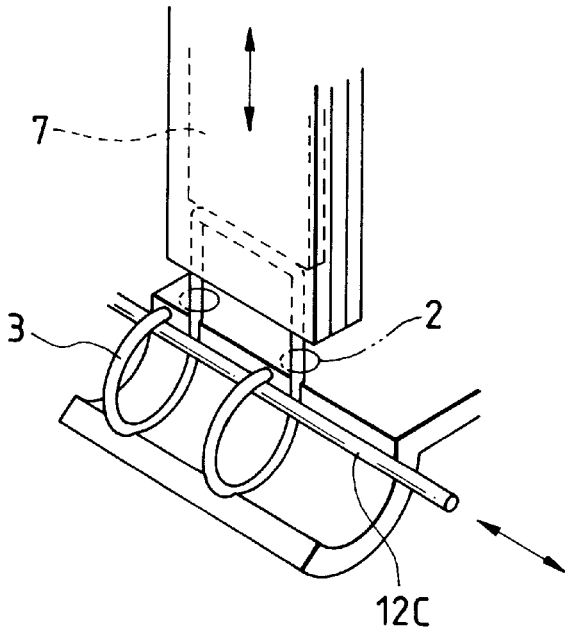
FIG. 17 shows another example of a fruclum member of a binding device according to a still further embodiment of the invention.

Fulcrum members are not limited to plate-like shape members. As shown in FIG. 17, a fulcrum member 12C formed in the shape of a cylinder may be used. In this case, the fulcrum member 12C is provided such that the fulcrum member 12C is movable in its axial direction, and retractable from the bind member 3 after the bind member 3 is bent into a ring-shape.

Figure 18:
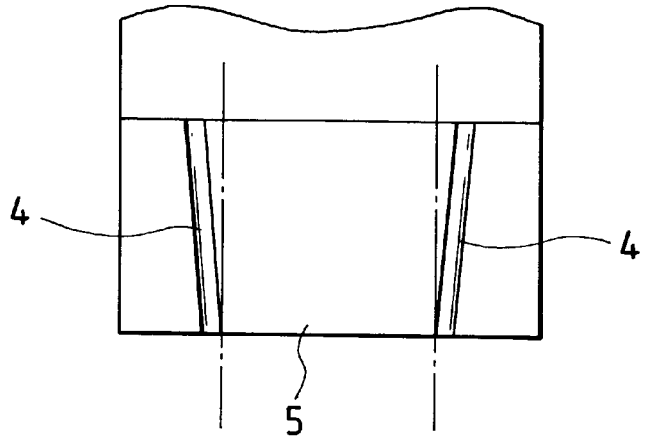
FIG. 18 shows shaping guide grooves of a shaping block of a binding device according to a still further embodiment of the invention.

FIG. 18 shows shaping guide grooves of a shaping block of a binding device according to a still further embodiment of the invention. These shaping guide grooves 4 of the shaping block 5 are not parallel to each other, but the shaping guide grooves 4 are formed such that an interval between the shaping guide grooves 4 near the leading ends 17 of the legs 3*b* is smaller than that of the root portion 18 of the bind member 3.

Figure 19:
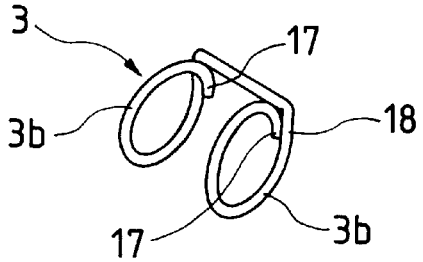
FIG. 19 shows a bind member bent by the shaping guide grooves of the shaping block.

FIG. 19 shows a bind member 3 bent by the shaping guide grooves 4 of the shaping block 5. Since the interval between the shaping guide grooves 4 near the leading ends 17 of the legs 3*b* is smaller than that of the root portion 18 of the bind member 3, the leanding ends 17 are simultaneously bent into a circular shape and guided inside the root portion 18. In other words, the legs 3*b* are bent into a spiral shape.

Non-parallel grooves are not complicated structures, but have a great advantage: The leading ends 17 of the legs 3*b* are urged towards the interior of the root portion 18, and therefore, projects away from the fulcrum. Consequently, the projections 12 of the face plate 6 which serve as fulcrums are movable without any interference.

What is claimed is:

1. A binding device for binding a stack of sheets with a bind member in which at least one leg of the bind member perpendicularly extends away from a straight portion of the bind member, the straight portion of the bind member defining a first axis and the at least one leg of the bind member defining a second axis, said binding device comprising:

a driver plate which drives said bind member in a direction along an axis substantially parallel to said second axis;

a shaping block with at least one shaping guide groove to guide said at least one leg of said bind member about an axis substantially parallel to said first axis; and at least one fulcrum member to displace an end of said at least one leg of said bind member along an axis substantially parallel to said first axis, wherein said at least one leg of said bind member is formed into a substantially ring-like shape, with said end of said at least one leg of said bind member being passed through at least one opening in said stack of sheets, thereby binding said stack of sheets with said bind member.

2. The binding device according to claim 1, wherein said shaping block is a plate having a front edge, a back edge, a left edge, and a right edge defining a first plane, wherein said plate is positioned with said front edge and said back edge of said plate substantially parallel to said first axis, and an angle between said first plane and said second axis greater than 90 degrees thereby forming an obtuse angle.

3. The binding device according to claim 1, wherein said at least one fulcrum member is movable between a forming position wherein said at least one fulcrum member displaces said end of said at least one leg of said bind member substantially along said axis substantially parallel to said first axis, and a retracted position wherein said at least one fulcrum member does not displace said at least one leg of said bind member.

4. The binding device according to claim 3, wherein said at least one fulcrum member has an escape portion to prevent said at least one leg of said bind member from resting against said at least one fulcrum member.

5. The binding device according to claim 1, wherein said shaping block includes two shaping guide grooves, said shaping guide grooves being substantially non-parallel to each other.

6. The binding device according to claim 1, wherein said at least one fulcrum member is movable perpendicular to a movable direction of said driver plate, wherein said stack of sheets are positioned on said at least one fulcrum member and said end of said at least one leg of said bind member is substantially aligned with said at least one opening in said stack of sheets, thereby allowing said end of said at least one leg of said bind member to pass through said at least one opening in said stack of sheets before said end of said at least one leg of said bind member is guided by said at least one shaping guide groove.

7. The binding device according to claim 1, wherein said at least one fulcrum member is located substantially adjacent an end of said at least one shaping guide groove, wherein said at least one fulcrum member engages a side of said at least one leg of said bind member.

8. The binding device according to claim 1, wherein said at least one shaping guide groove displaces said end of said at least one leg of said bind member along said axis substantially parallel to said first axis before said end of said at least one leg of said bind member is displaced by said at least one fulcrum member.

9. The binding device according to claim 1, wherein said at least one shaping guide groove has a semicircular shape.

10. The binding device according to claim 1, wherein said at least one shaping guide groove has an arcuate shape of a quadrant of a circle.

11. The binding device according to claim 1, wherein said at least one shaping guide groove has an arcuate shape of three quadrants of a circle.

12. A binding device for binding a stack of sheets with a bind member in which two legs of the bind member perpendicularly extend away from a straight portion of the bind member, the two legs of the bind member substantially parallel to each other, the straight portion of the bind member defining a first axis and a leg of the bind member defining a second axis, said binding device comprising:

a driver plate which drives said bind member in a direction along an axis substantially parallel to said second axis;

a shaping block with two shaping guide grooves to guide said legs of said bind member about an axis substantially parallel to said first axis; and two fulcrum members to displace ends of said legs of said bind member along an axis substantially parallel to said first axis, wherein said legs of said bind member are formed into substantially ring-like shapes, with said ends of said legs of said bind member being passed through at least one opening in said stack of sheets, thereby binding said stack of sheets with said bind member.

13. The binding device according to claim 12, wherein said shaping block is a plate having a front edge, a back edge, a left edge, and a right edge defining a first plane, wherein said plate is positioned with said front edge and said back edge of said plate substantially parallel to said first axis and an angle between said first plane and said second axis greater than 90 degrees thereby forming an obtuse angle.

14. The binding device according to claim 12, wherein said fulcrum members are movable between a forming position wherein said fulcrum members displace said ends of said legs of said bind member along said axis substantially parallel to said first axis, and a retracted position wherein said fulcrum members do not displace said ends of said legs of said bind member.

15. The binding device according to claim 14, wherein said fulcrum members have an escape portion to prevent said legs of said bind member from resting against said fulcrum members.

16. The binding device according to claim 12, wherein said shaping guide grooves are substantially non-parallel to each other.

17. The binding device according to claim 12, wherein said fulcrum members are movable perpendicular to a movable direction of said driver plate, wherein said stack of sheets are positioned on said fulcrum members and said ends of said legs of said bind member are substantially aligned with said at least one openings in said stack of sheets, thereby allowing said ends of said legs of said bind member to pass through said at least one opening in said stack of sheets before said ends of said legs of said bind member are guided by said shaping guide grooves.

18. The binding device according to claim 12, wherein said fulcrum members are located substantially adjacent ends of said shaping guide grooves, wherein said fulcrum members engages sides of said legs of said bind member.

19. The binding device according to claim 12, wherein said shaping guide grooves displace said ends of said legs of said bind member along said axis substantially parallel to said first axis before said ends of said legs of said bind member are displaced by said fulcrum members.

20. The binding device according to claim 12, wherein said shaping guide grooves have a semicircular shape.

21. The binding device according to claim 12, wherein said shaping guide grooves have an arcuate shape of a quadrant of a circle.

22. The binding device according to claim 12, wherein said shaping guide grooves have an arcuate shape of three quadrants of a circle.

23. The binding device according to claim 5, wherein said shaping guide grooves are formed such that an interval between said shaping guide grooves at a location where said end of said at least one leg of said bind member enters said shaping guide grooves is larger than an interval between said shaping guide grooves at a location where said end of said at least one leg of said bind member exits said shaping guide grooves.

24. The binding device according to claim 16, wherein said shaping guide grooves are formed such that an interval between said shaping guide grooves at a location where said ends of said legs of said bind member enter said shaping guide grooves is larger than an interval between said shaping guide grooves at a location where said ends of said legs of said bind member exit said shaping guide grooves.

* * * * *